United States Patent [19]

Hodges, III et al.

[11] 4,016,510

[45] Apr. 5, 1977

[54] BROADBAND TWO-PORT ISOLATOR

[75] Inventors: Eugene Walton Hodges, III, Sunrise; Francis Robert Steel, Parkland; Ralph Thomas Enderby, Coral Springs, all of Fla.

[73] Assignee: Motorola, Inc., Schaumburg, Ill.

[22] Filed: May 3, 1976

[21] Appl. No.: 682,686

[52] U.S. Cl. ..... 333/24.2; 333/84 M

[51] Int. Cl.[2] ..... H01P 1/36

[58] Field of Search ..... 333/1.1, 24.1, 24.2

[56] References Cited

UNITED STATES PATENTS

| | | | |
|---|---|---|---|
| 3,016,497 | 1/1962 | Kostelnick | 333/24.2 |
| 3,219,941 | 11/1965 | Engelbrecht | 333/24.2 X |

FOREIGN PATENTS OR APPLICATIONS

| | | | |
|---|---|---|---|
| 6,504,060 | 10/1965 | Netherlands | 333/24.2 |

*Primary Examiner*—Paul L. Gensler
*Attorney, Agent, or Firm*—Margaret Marsh Parker; James W. Gillman

[57] ABSTRACT

A non-reciprocal signal path for RF over a broadband frequency range is provided by an isolator comprising two coils or meshes positioned at 90° to each other adjacent at least one gyromagnetic or ferrite disc which is magnetically biased by a static magnetic field. Each coil is tuned by a parallel capacitor, each coil and capacitor having one end grounded to a surrounding electromagnetic shield. A resistive unilateralizing element is coupled between the input and output terminals and, being essentially non-reactive, provides the broadband characteristic. The energy from the reverse direction is dissipated externally in the resistive element. A magnetic return path of a high permeability material allows the use of smaller biasing magnets and reduces the effects of external magnetic fields.

9 Claims, 4 Drawing Figures

BROADBAND TWO-PORT ISOLATOR

BACKGROUND OF THE INVENTION

This invention relates to the field of isolators for use at high frequencies and more particularly to such devices having a broadband characteristic.

Present state of the art falls generally into two types of devices, terminated circulators and resonance isolators. Both types may be used to isolate one portion of a circuit from the following stages. A circulator is a device having generally three or four ports or even comprising two or more three-port devices combined. It is a non-reciprocal device in which the energy entering at a first port is transmitted to a second port with a minimum of attenuation or loss, assuming that the second port terminates in a matching impedance, whereas, energy entering at the second port is directed almost completely to a third port, at which it may be dissipated in a matching impedance. Thus, considering ports one and two, the circulator functions as an isolator. The biggest disadvantage of this type of device is that it is inherently narrowband, since the matching impedance at the third port must be reactive and, therefore, frequency dependent.

The resonance isolator as now known in the art is typically a two-port device with isolation realized by means of a gyromagnetic resonance of the ferrite material, with no exterior unilateralizing element used. Such isolators are only effective at frequencies near the resonant frequency of the material, thus are also inherently narrowband devices. Additionally, since the gyromagnetic resonance is determined to a great extent by the strength of the applied magnetic field, the operation of the device is sensitive to temperature changes which alter that magnetic field. This limits the power handling capability of the device, since the lost energy is dissipated within the ferrite material. At temperatures above the Curie point, the exchange coupling in the ferrite material disappears, leaving it simply paramagnetic.

SUMMARY OF THE INVENTION

It is, therefore, an object of the invention to provide an isolator or non-reciprocal device for high radio frequencies which is small, simple and, most important, dependably operative over a broadband of frequencies.

These objectives are achieved by the present invention, in an isolator comprising an input terminal, an output terminal and a reference voltage source. A first conductor is coupled from the input terminal to the reference source and a second conductor is coupled from the output terminal to the reference source with its longitudinal axis at substantially 90° to the axis of the first conductor. Insulating means are provided for insulating the first conductor from the second conductor. At least one ferrite element is positioned adjacent the conductors. Magnetic means provide a static magnetic field, the field and second conductors and the ferrite elements being positioned in the magnetic field, and the field being normal to the plane of the ferrite element. An electromagnetic shield substantially surrounds the first aand second conductors, the ferrite element and the magnetic means, and is coupled to the second ends of the first and second conductive means. A first capacitor is coupled in parallel with the first conductor and a second capacitor is coupled in parallel with the second conductor. A resistive element is coupled between the input and output terminals.

DETAILED DESCRIPTION OF THE INVENTION

Figure 1:
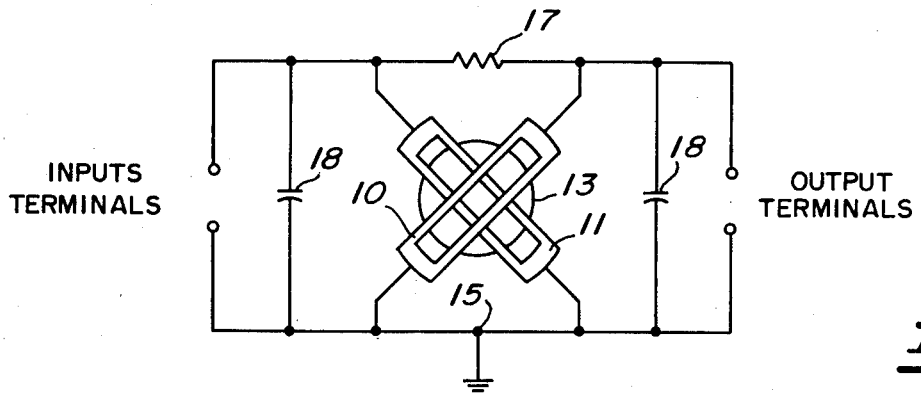
FIG. 1 is a partial schematic diagram of an isolator constructed in accordance with the invention.
Figure 2:
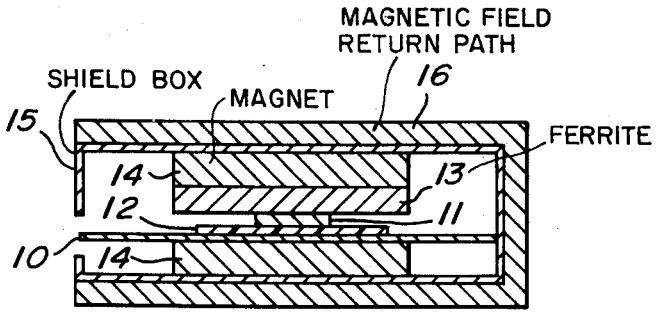
FIG. 2 is a cutaway side view in elevation of one embodiment.

Referring now more particularly to the drawing, in FIGS. 1 and 2, two conductors or meshes 10 and 11 are shown with longitudinal axes positioned at substantially 90° to each other, for minimum coupling. These conductors or meshes could be single wires, divided conductors or coils having more than one turn, depending on the operating frequency. The individual conductors may be flat for minimum thickness in the assembly and are preferably laminated to a flexible dielectric material such as Kapton. The meshes are insulated from each other by a thin sheet 12 of insulating material such as Mylar. A ferrite disc 13 is positioned adjacent the meshes and on each side of the assembly is a magnet 14. One end of each mesh is grounded to a copper shielding box 15 which surrounds the meshes, ferrite discs and magnets, and is connected to the system ground, serving as ground plane. A soft iron piece 16 partially surrounds the unit to provide a high permeability return path for the magnetic field. The iron piece 16 allows the use of smaller magnets and reduces the effect of external magnetic fields.

The ungrounded ends of the meshes 10, 11 are brought out of the copper box and are interconnected by means of a resistive element 17. The resistive element coupled across the meshes provides the unilateralizing characteristic over a broadband of frequencies and also dissipates the lost energy externally as will be explained subsequently. A capacitor 18 is coupled across each mesh and may be positioned inside or outside the copper box 15 and the iron piece 16. The capacitors 18 are for impedance matching at the input and output. Input connections are made to the input mesh 10 and output connections to the output mesh 11.

Figure 3:
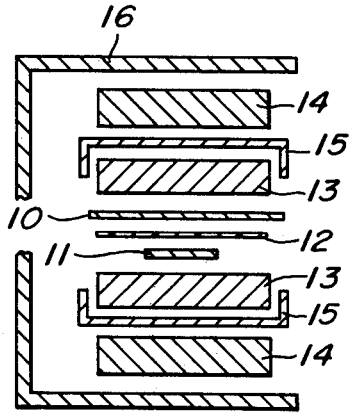
FIG. 3 is an exploded cutaway side view in elevation of another embodiment.

The embodiment of FIG. 3 is similar to that of FIG. 2 except that a second ferrite disc 13 is positioned opposite the first disc 13 and the magnets 14 are placed outside the copper shielding box 15. The principle of operation of the two embodiments is the same; only the frequency response differs. Because the device does not operate at the gyromagnetic resonance of the ferrite discs, the magnetic field adjustment is not critical as is the case in conventional resonance isolators and circulators. The disc 13 may be the general class of polycrystalline garnet type microwave ferrites, and particularly, substituted yttrium iron garnets. Desirable characteristics for this application are a fairly low saturation magnetism (400–1000 Gauss), narrow line width (40–55 Oersteds) and a high Curie temperature (135°–250° C.). The ferrite disc (or discs) 13 when magnetically biased by the appropriate static magnetic field provide a difference of nearly 20 db (FIG. 4) between insertion loss (curve 20) and reverse direction loss (curve 21).

Figure 4:
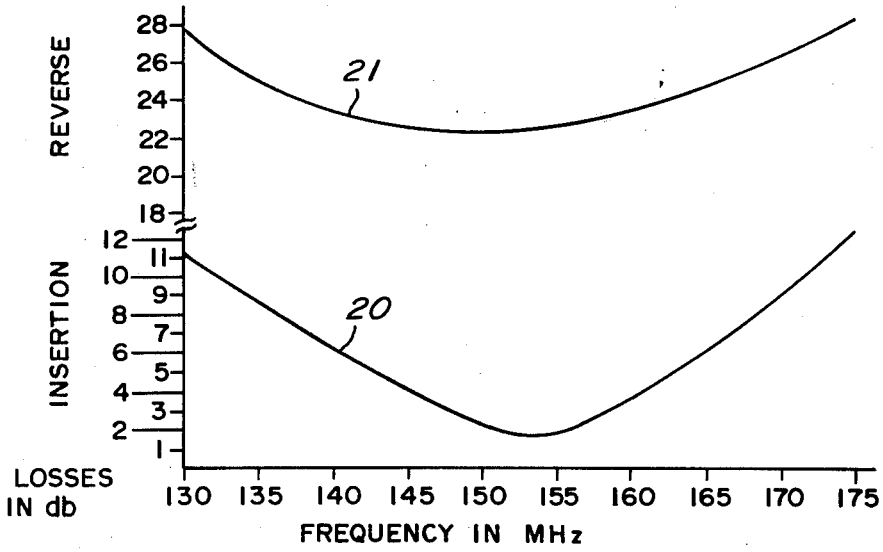
FIG. 4 is a graph of relative losses from the two directions through the isolator.

Curve 20 of FIG. 4 shows the insertion loss of an embodiment designed for use in the frequency range from 130 mHz to 170 OmHz. Curve 21 shows the loss through the isolator in the reverse direction. The scale of the oridinate is in db's with a break as indicated between 12 db and 18 db for compactness of the figure. The curves of FIG. 4 show not only the difference between insertion loss and reverse direction loss but the broadband characteristic which is the main feature of the invention. This characteristic is not available in devices of the prior art, since they utilize either the gyromagnetic resonance of a ferrite material or have reactive impedance matching circuits which make the devices highly frequency dependent.

A typical application (not shown) of the invention would be the isolation of a voltage controlled oscillator (VCO) from the frequency pulling effects of later transmitter stages of the portable unit. The broadband characteristic, the external energy dissipation ad less critical magnetic field adjustment are particularly desirable in a small, compact unit. It appears that the invention is operable over a frequency range extending at least from 130 MHz to 2,000 MHz.

It is evident that other variations and modifications than those shown herein are possible and it is here intended to include all those falling within the spirit and scope of the appended claims.

What is claimed is:

1. A broadband two-port isolator especially suited for used with high frequency radio frequency apparatus, the isolator having input and output terminals and comprising in combination:

a reference voltage source;

a first conductor means connected between the input terminal and the voltage reference source;

a second conductor means connected between the output terminal and the voltage reference source, and further having its longitudinal axis at substantially 90° to the axis of the first conductor;

means for insulating the first conductor from the second conductor;

at least one gyromagnetic element positioned in close proximity to the conductors;

magnetic means for providing a static magnetic field, the first and second conductors and the at least one gyromagnetic element being positioned inside said magnetic field and the field being normal to the plane of the at least one gyromagnetic element;

first and second capacitors each connected in parallel with a respective one of said first and second conductor means; and resistive means connected between the input and output terminals.

2. The isolator according to claim 1, wherein the magnetic means includes at least two magnets.

3. The isolator according to claim 2 further including an electromagnetic shield and wherein the first and second conductor means, and the at least one gyromagnetic element are substantially contained within said shield, said shield being connected to said reference voltage source.

4. The isolator according to claim 3 wherein the magnets are contained within the electromagnetic shield.

5. The isolator according to claim 2 wherein the magnetic means further includes a high permeability return path for the magnetic field of said magnets.

6. The isolator according to claim 5 wherein said return path is a soft iron piece positioned adjacent and partially surrounding the electromagnetic shield.

7. The isolator according to claim 3 wherein the conductive electromagnetic shield is a cover housing having at least one aperture.

8. The isolator according to claim 1 wherein the at least one gyromagnetic element comprises polycrystalline garnet type microwave ferrite discs.

9. The isolator according to claim 8 wherein the ferrite discs are composed of one of a group of substituted yttrium iron garnets.

* * * * *